US005283769A

United States Patent [19]

Renton

[11] Patent Number: 5,283,769

[45] Date of Patent: Feb. 1, 1994

[54] CLOCK

[76] Inventor: Julian E. Renton, Frankleigh Farm, Bath Road, Bradford on Avon BA15 2PF, England

[21] Appl. No.: 966,168

[22] PCT Filed: Jun. 4, 1991

[86] PCT No.: PCT/GB91/00890

§ 371 Date: Jan. 25, 1993

§ 102(e) Date: Jan. 25, 1993

[87] PCT Pub. No.: WO91/19234

PCT Pub. Date: Dec. 12, 1991

[30] Foreign Application Priority Data

Jun. 4, 1990 [GB] United Kingdom ..... 9012385.2

[51] Int. Cl.[5] ..... G04B 21/02; G04C 21/00

[52] U.S. Cl. ..... 368/74; 368/250

[58] Field of Search ..... 368/72–75, 368/223, 269, 246, 250, 251, 262, 269, 272–273

[56] References Cited

U.S. PATENT DOCUMENTS

| | | | |
|---|---|---|---|
| 2,791,853 | 5/1957 | Coons et al. | 40/139 |
| 3,247,614 | 4/1966 | Spengler | 46/177 |
| 4,730,284 | 3/1988 | Adams | 368/72 |
| 4,941,137 | 7/1990 | Kikuchi | 368/223 |
| 5,047,998 | 9/1991 | Aizpwa et al. | 368/75 |
| 5,050,140 | 9/1991 | Albert | 368/262 |

FOREIGN PATENT DOCUMENTS

| | | |
|---|---|---|
| 177703 | 10/1986 | France . |
| 2201608 | 9/1988 | United Kingdom . |

*Primary Examiner*—Vit W. Miska
*Attorney, Agent, or Firm*—Larson and Taylor

[57] ABSTRACT

A children's night and day clock has different appearances during the day and the night. Change is actuated by an alarm mechanism (9) which is linked to mechanically interdependent display elements (54, 56, 58) so that, at a preset time, they undergo a change in their mechanical positional relationship between the expression of night or sleeping time and day or waking time. Push button (18) is depressed to actuate the transition from day to night time. It lowers a lever (16; 116) which is then held in a loaded position against the urging of a spring (22; 122) by means of a latch (24; 180). When the clock reaches the present time, the latch is released and the clock reverts from the night configuration to the day configuration. Thereafter it remains in the day configuration until reset.

7 Claims, 3 Drawing Sheets

CLOCK

TECHNICAL FIELD

This invention relates to a clock, particularly to a clock for children.

Existing children's clocks do not have the facility to help children who have not yet learnt to read the time displayed on a clock to relate clock time to night or sleeping time and day or waking time. This facility would be useful in assisting children to begin to understand the basic principles and purpose of clock time. Also, many of these children unwittingly disrupt the normal day or waking time of their families or guardians by waking earlier and assuming an earlier start to the day because they are unable to relate to and understand the clock measurement of time and to differentiate between night and day.

BACKGROUND ART

The conventional alarm clock brings to the attention a pre-determined point in time by means of an audible alarm, but it does not differentiate between the time before and after the sounding of the alarm in a way that children, who are unable to read the time displayed on a clock, can relate to. A cuckoo clock indicates certain times by visual signals, but these are transient. For a child unable to read a clock, the cuckoo signal would probably convey no useful information and, when the signal was not being produced the clock would certainly be wholly uninformative.

DISCLOSURE OF INVENTION

The present invention provides a clock having a clock mechanism, display means which are displaceable between first and second configurations, in at least one of which they are at least partly visible from the exterior of the clock so that the configurations are visually distinct; and means coupling the display means to the clock mechanism so that at a predetermined time the clock mechanism actuates the coupling means whereby it tends to urge the display means from the first to the second configuration; characterised in that said display means tend to remain in the second configuration until the clock is reset, so that the state of the clock after the predetermined time is visually distinct from the state of the clock before the predetermined time on the basis of the configuration of the display means.

Generally, a clock embodying the invention has an arrangement of mechanically interdependent parts which can undergo a reversible physical change between the expression of night or sleeping time and that of day or waking time as intended to be understood and interpreted by children who have not learnt to read a conventional clock. The clock mechanism is adapted to cause a change in the mechanical relationship of the parts at a preelected time. It may be triggered by a generally convention alarm clock type mechanism. There should be a means of reversing the change at a later time and which may be either manually actuated or pre-selected for automatic actuation.

Many clock mechanisms operate by means of an electric motor which drives the clock hands by way of a series of gears. Such clock mechanisms which are often used in alarm clocks initiate the sounding of the alarm by means of an electrical switch which closes when the alarm hand assumes the same angular position as the hour hand. This completes an electrical circuit allowing an electrical device to emit a sound.

An alarm clock mechanism of the present invention can be extended to include an electro-mechanical device such as a motor solenoid or other induced magnetic device which is used to release a latch which initiates the change from the asleep or night time position. Such a device can be activated as result of the closure of the alarm switch provided in the clock mechanism allowing power to be transmitted to such an electro-mechanical device by means of an appropriate power source.

Some embodiments of the invention will now be described by way of example with reference to the accompanying drawings.

MODES FOR CARRYING OUT THE INVENTION

Figure 1:
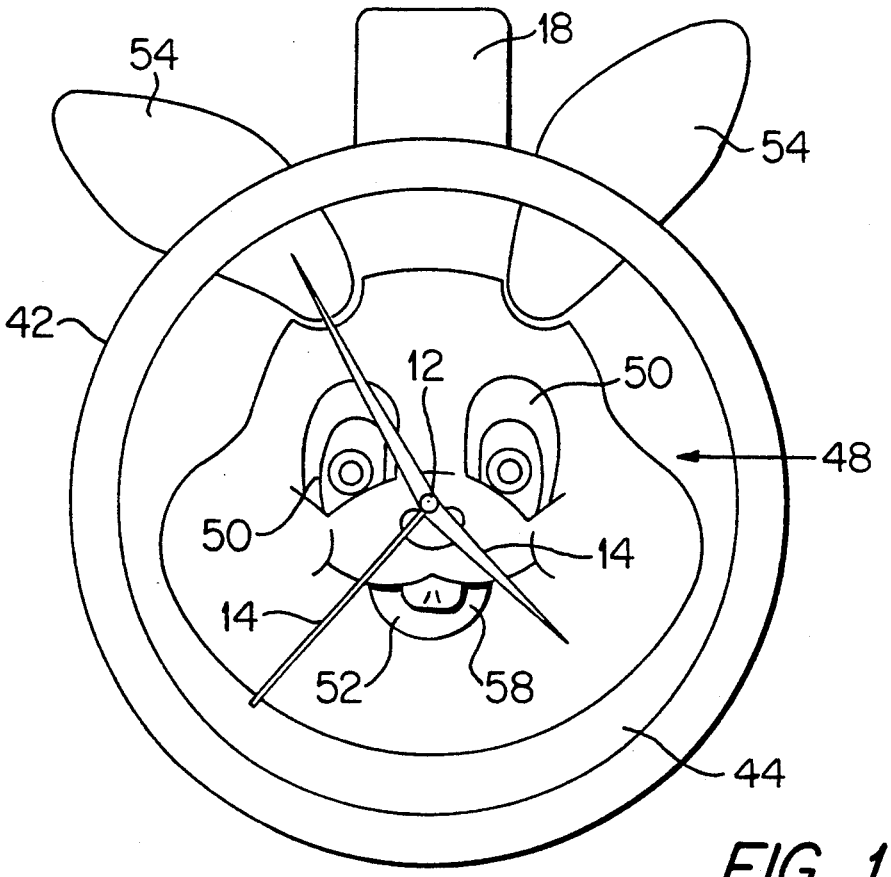
FIG. 1 shows a front elevation of a first embodiment of the clock in the day or awake mode.
Figure 2:
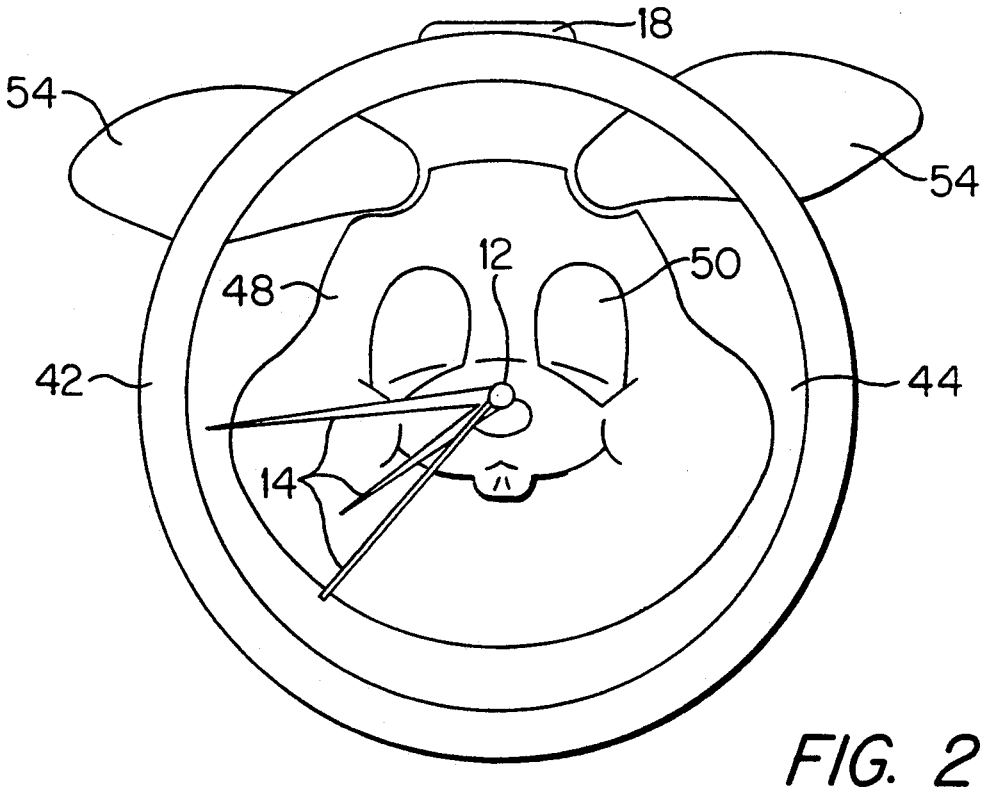
FIG. 2 shows a front elevation of the clock in the night or sleeping mode.
Figure 3:
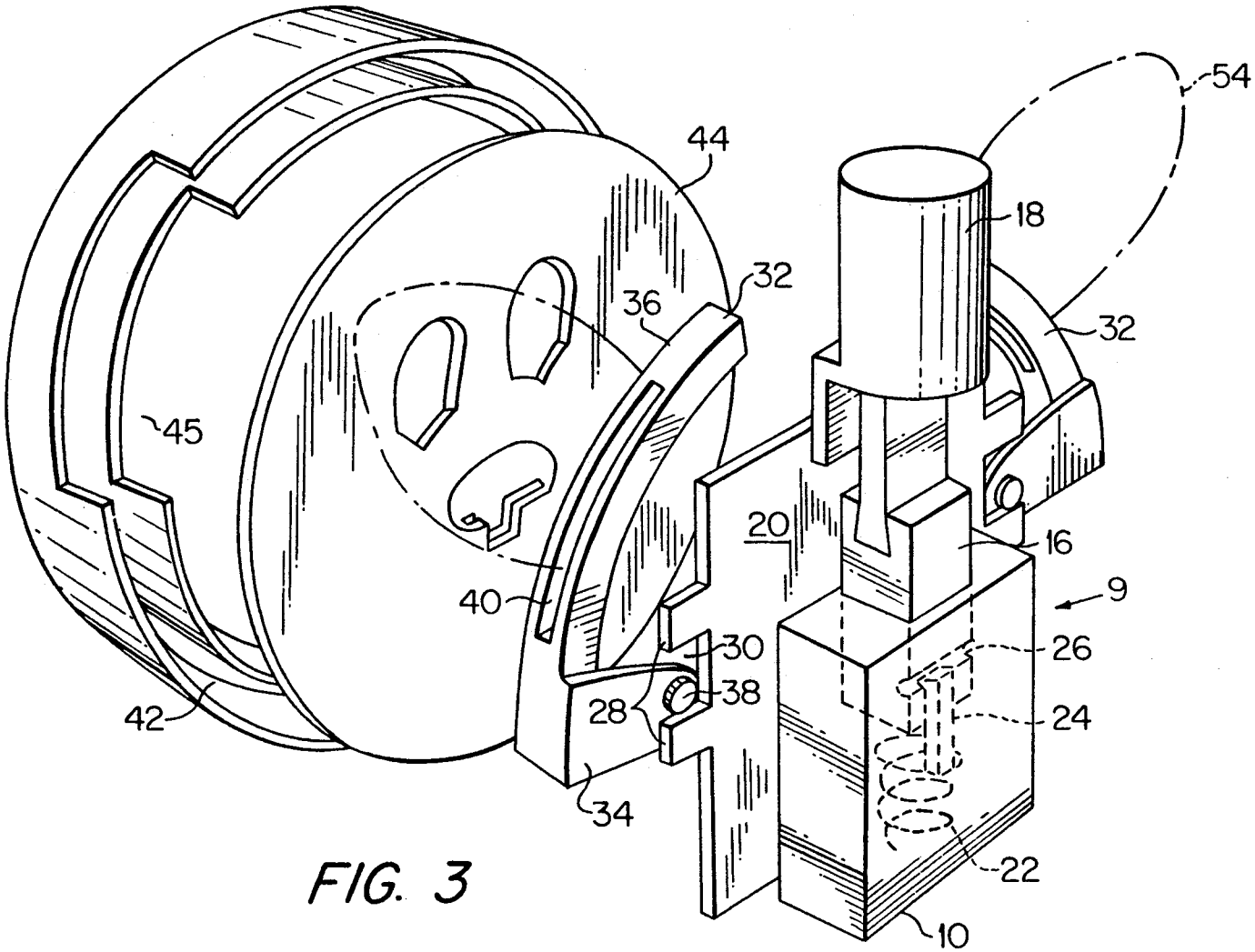
FIG. 3 shows in perspective the relationship between the clock mechanism and a number of the mechanically interdependent parts.

As shown in FIGS. 1 to 3, a clock has a substantially conventional mechanical alarm clock mechanism 9, powered electrically or by clockwork. Thus, there is a housing 10 from which three concentric hand-bearing shafts 12 extend forwardly. These carry conventional hour, minute and alarm hands 14. The alarm hand can be moved to a position corresponding to a desired time. When the hour hand reaches this position, actuation occurs. A variant in which the alarm works on a 24 hour clock is also possible, so that, for example, actuation can be set to occur at 7 a.m. and not 7 p.m.. Details of such mechanisms are well-known to those skilled in the art. In a conventional alarm clock, actuation leads to transient operation of a sounder. This may happen with the present clock, but is not essential.

Associated with the clock mechanism 9 is a lever 16 which is associated with an upwardly extending push button 18 and a plate 20 that extends in front of the mechanism housing 10. The plate 20 has an opening through which the shafts 12 extend. The lever, button and plate are vertically movable together. They are urged upwardly by a spring 22 within the alarm clock mechanism. The mechanism also includes detent means for retaining the lever 16 in the lowered position (shown schematically as a pawl 24 engaging a recess 26 in the lever). The alarm mechanism is adapted to release the detent means on actuation, so that the lever 16, button 18 and plate 20 move suddenly upwardly to an upper configuration.

The plate 20 is generally rectangular with a pair of projections 28 on each lateral side, defining recesses 30 between them. A pair of ear guides 32 are each generally L-shaped with a short limb 34 and an arcuate long limb 36. Each short limb has an abutment piece 38 adjacent its free end. This extends through a plate recess 30. Each arcuate long limb has a slot 40 extending through much of its length.

The clock has a cylindrical casing including a bezel 42 and a face 44. The bezel 42 has openings 45 adjacent the slots 40 in the ear guides 32. The face 44 has a central opening for the shafts bearing the hands 14. It bears a representation of an animal's face 48 (in this example, a rabbit's), with apertures 50, 52 in the regions of the eyes and mouth. Movable elements 54, here representing ears, are pivotally connected to the face and project centrally through the slots 40 and bezel openings 45. The plate 20 bears open and closed eye representations 56, one of which is visible through each of the eye apertures 50. A representation of a tongue 58 is visible at the mouth aperture 52. It may be simply delineated on the plate 20, or there may be a tongue element coupled to the plate 20 as explained later.

The ear guides 32 are loosely positioned in the outer rim of the bezel 42 and are free to move in a circular path about the central axis of the clock face 44.

FIG. 1 shows the 'day' configuration in which the lever 16, button 18 and plate 20 are in the upper configuration. This position of the plate means that the open eye representations 56 show at the eye apertures 50, and the tongue 58 is visible at the mouth aperture 52. Furthermore, the ear guides 32 hold the ears 54 in the erect configuration.

In order to change the clock from the awake or day time position in FIG. 1 to the asleep or night time position in FIG. 2, push button 18 is depressed constraining the eye plate 20 to move downwards in relation to the clock face 44. Thus the eye apertures 50 now reveal the closed eye graphic representations. (Alternatively, the eyes could assume a closed state by means of a plate or eye lid passing over the open eye graphic representation.) The ear guides 32 in which the ears 54 are loosely located are linked to the eye plate 20 and are constrained to move downwards with it, urging the ears to pivot to their lowered positions. The ear guides 32 in the depressed position together with the ears 54 close access through the ear slot openings 45 in the clock bezel 42. Tongue 58 may be an element permanently fixed to a link pivoted from a peg in the back of the clock face 44. It then rotates upwards about the pivot into a slot aperture in the clock face 44 and becomes hidden behind the clock face 44. The clock mechanism lever or button 18 which is mechanically linked to the eye plate 1 is depressed against the spring 22 and is held in the depressed position by the releasable latch 24.

In order to change the clock from the asleep or night time position in FIG. 2 to the awake or day time position in FIG. 1, the alarm hand and the hour hand 14 assume the same angular position about the central axis of the clock face 44 and trigger the alarm mechanism which actuates release of the latch. Lever or button 18 is constrained to move with the spring, and the eye plate 20, ear guides 32, ears 54, tongue 58 and push button 18 are moved with it so that the clock returns to the awake or day time state as in FIG. 1.

Figure 4:
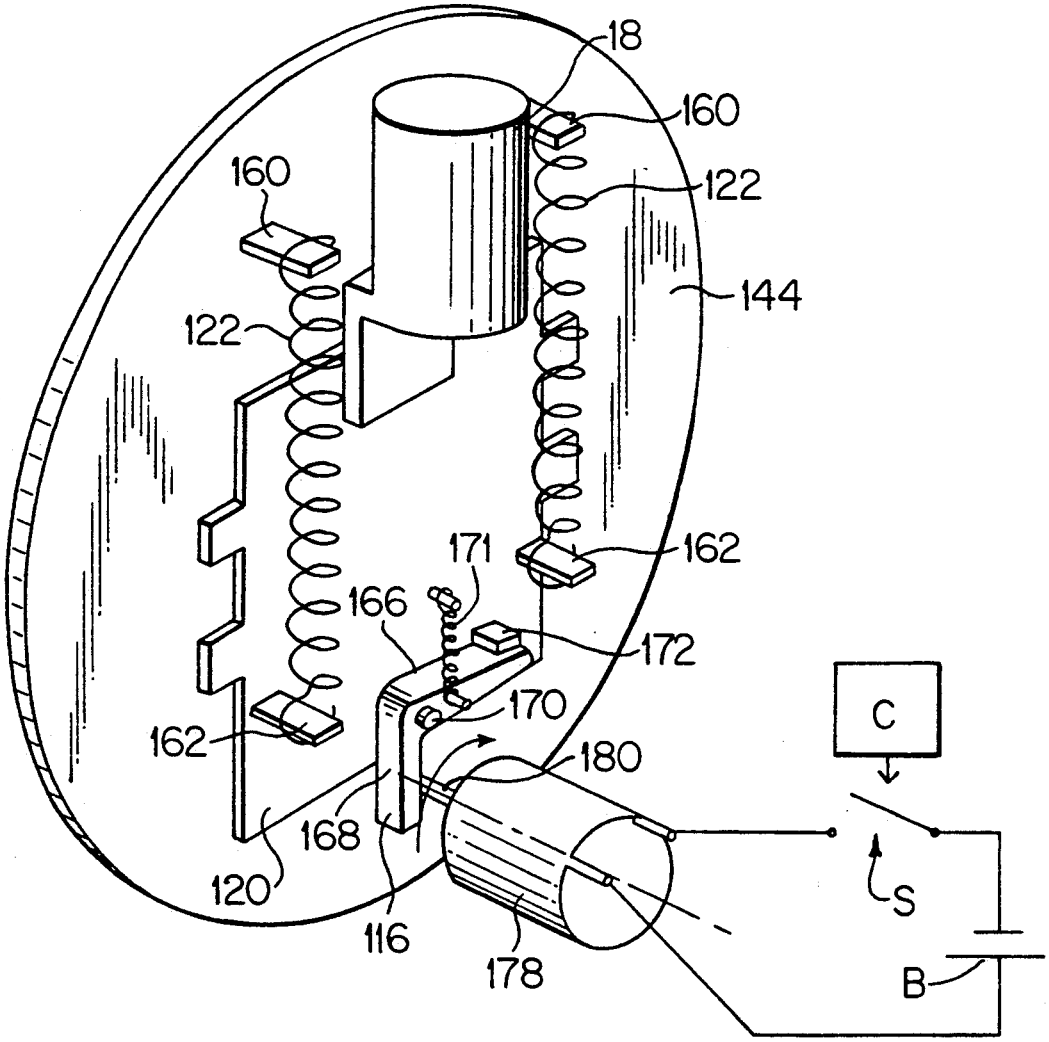
FIG. 4 is a view like FIG. 3 but showing a second embodiment.
Figure 5:
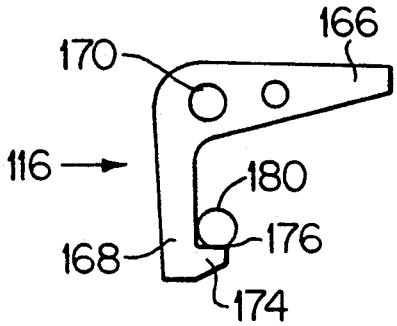
FIG. 5 is a front view of a lever member of the FIG. 4 embodiment.

FIG. 4 shows details of a preferred variant of the mechanism, in the 'night' configuration. The clock face 144 and eye plate 120 are the same as those previously described except for pairs of rearward projections 160, 162. Tension springs 122 extend between projections on plate and face to urge the plate upwardly. The plate carries a push button 18 as before. The lever arrangement is different. Thus, an L-shaped lever 116 is pivoted to the plate 120 so that its arms 166, 168 extend generally horizontally and downwardly from the pivot 170. A spring 171 extends from one arm 166 to the plate to urge the lever to pivot anticlockwise to abut stop 172 on the plate. The downward limb 168 has adjacent its free end a projection 174 providing an upwardly facing contact surface 176.

An electric motor 178 is mounted so as to be fixed relative to the clock face 144. It has a rotatable shaft 180 that extends so that it can contact the contact surface 176 as shown in FIG. 4. The engagement of the shaft 180 and surface 176 prevents the plate 20 from moving as urged by the tension springs 122. However, if the motor is actuated to rotate the shaft clockwise, it moves the abutment surface to the left, pivoting the lever clockwise, until the plate is free to be raised by the springs 122. Thus, it will be appreciated that the clock mechanism is arranged to actuate the motor briefly at the set time, to trigger the change in the state of the clock. As shown schematically, the mechanism C closes a switch S briefly to provide power to the motor from a battery B that may also power the clock mechanism C. Since the motor only requires power for a fraction of a second, the drain on the battery is small.

As with the first embodiment, the clock is reset from 'day' to 'night' by pressing down on the push button 18. This moves the plate down, and the contact surface 176 latches beneath the (stationary) motor shaft.

I claim:

1. A clock having a clock mechanism, display means which are displaceable between first and second configurations, in at least one of which they are at least partly visible from the exterior of the clock so that the configurations are visually distinct; and means coupling the display means to the clock mechanism so that at a predetermined time the clock mechanism actuates the coupling means whereby it tends to urge the display means from the first to the second configuration; wherein said display means tend to remain in the second configuration until the clock is reset, so that the state of the clock after the predetermined time is visually distinct from the state of the clock before the predetermined time on the basis of the configuration of the display means; said coupling means comprising an element movable between first and second configurations; characterised in that there are urging means urging said element to its second configuration; and releasable latching means for retaining the element in its first configuration; the latching means being coupled to the clock mechanism so that, at the predetermined time, the latching means releases the element.

2. A clock according to claim 1 having a casing there being at least one opening in the casing; said display means comprising at least one display element which in one configuration of the display means projects outwardly of the casing through said opening and which, in the other configuration does not project, or projects to a lesser extent.

3. A clock according to claim 1 wherein said display means comprises a pivoted member, and said movable element urges pivoting thereof.

4. A clock according to claim 1 wherein said latching means comprises electrically actuable displacement means having a movable latch element for retaining/releasing said movable element; and switch means arranged to be actuable by the clock mechanism to actuate movement of the latch element to release said movable element.

5. A clock according to claim 4 wherein said electrically actuable displacement means comprises a solenoid and a magnetic follower.

6. A clock according to claim 4 wherein said electrically actuable displacement means comprises a rotary electric motor.

7. A clock according to claim 5 wherein said motor has a rotatable shaft and said latching means includes a displaceable contact member which is urgeable by said urging means away from said shaft but which is engageable with said shaft to resist said urging; said contact member being laterally displaceable by rotation of the shaft to release said engagement.

* * * * *